United States Patent [19]

Nakamura et al.

[11] 4,337,399

[45] Jun. 29, 1982

[54] REFRIGERATOR

[75] Inventors: Hiroyuki Nakamura, Yokohama; Shuniti Nakaya, Kawasaki, both of Japan

[73] Assignee: Tokyo Shibaura Denki Kabushiki Kaisha, Kawasaki, Japan

[21] Appl. No.: 104,802

[22] Filed: Dec. 18, 1979

[30] Foreign Application Priority Data

Dec. 22, 1979 [JP] Japan ..... 54/174889[U]

[51] Int. Cl.[3] ..... B60H 3/04; H02P 9/04

[52] U.S. Cl. ..... 290/1 R; 62/134

[58] Field of Search ..... 62/87, 88, 134; 74/57, 74/797, 802; 290/1 R, 1 C

[56] References Cited

U.S. PATENT DOCUMENTS

| | | | |
|---|---|---|---|
| 37,110 | 12/1862 | Rochow | 74/802 |
| 1,195,665 | 8/1916 | Etter | 74/57 |
| 2,078,953 | 5/1937 | Levin | 62/87 |
| 3,196,631 | 7/1965 | Holland | 62/87 |

FOREIGN PATENT DOCUMENTS

| | | |
|---|---|---|
| 1501603 | 1/1970 | Fed. Rep. of Germany . |
| 1501157 | 7/1970 | Fed. Rep. of Germany . |
| 2246356 | 3/1974 | Fed. Rep. of Germany . |

*Primary Examiner*—J. V. Truhe
*Assistant Examiner*—Shelley Wade
*Attorney, Agent, or Firm*—Oblon, Fisher, Spivak, McClelland & Maier

[57] ABSTRACT

Disclosed is a refrigerator which comprises a plurality of reciprocating motion type expansion engines, a converter mechanism, a speed-up mechanism, and a energy converting mechanism. The engines and the three mechanisms are assembled solidly so that they are successively direct-coupled in a main direction substantially parallel to a direction in which pistons of the engines reciprocate. The converter mechanism converts reciprocating motion of the pistons into rotation by means of a cylindrical cam with an output shaft extending along the main direction, the speed-up mechanism increases the rotation speed of the cylindrical cam and rotates the output shaft at high speed, and the energy converting mechanism includes a generator section having a rotor direct-coupled to the output shaft, electric power generated at the generator section being consumed by an electric load located in a suitable position when the rotor is rotated at high speed.

8 Claims, 7 Drawing Figures

REFRIGERATOR

This invention relates to a refrigerator provided with a refrigerating means including a plurality of reciprocating motion type expansion engines with reciprocating pistons extending substantially parallel and in the same direction with one another from their corresponding cylinders.

Refrigerators of the aforesaid type have conventionally been used. In such prior art refrigerators, however, the operating speed of engines cannot be increased, so that only a low rotation speed can be obtained with use of a conventional motion converting means which converts one cycle of reciprocating motion of a piston into one revolution. Accordingly, a flywheel mounted on an output shaft of the motion converting means for maintaining the smoothness of the rotation cannot help being large-sized. Further, in the case of using an electro-magnetic brake or electric-power generator for the purpose of effectively consuming the mechanical energy issued from the engine, large-diameter brake disk or large-diameter rotor is required to be employed. This causes the device to become bulky. To remove these drawbacks, there was a proposition that a mechanism for increasing the speed of the rotation should be provided separately from the motion converting means and the mechanical energy consuming means, which was not, however, able to prevent the overall size of the refrigerator from being large. Meanwhile, as the study of superconduction is advanced, the range of application of the superconduction to the fields of spacecraft and aircraft is widened. Moreover, as a technique of magnetically elevating rapid trains has been developed, there has been an increasing demand for the development of compact refrigerators capable of being set in a narrow space.

A first object of this invention is to provide a compact and light refrigerator free from the above-mentioned drawbacks of the prior art refrigerators.

In order to attain the aforesaid first object, the refrigerator of the invention is provided with a converting mechanism having a first output shaft parallel to the extending direction of pistons or main direction and driven by the pistons, whereby reciprocating motion of the pistons is converted into rotation of the first output shaft, a speed-up mechanism having a second output shaft parallel to the main direction and driven by the first output shaft, whereby the second output shaft is rotated faster than the first output shaft, and an energy consuming mechanism composed of an energy converting mechanism having a rotation part mounted on the second output shaft and converting mechanical energy supplied from the second output shaft into electrical energy and a load means to consume the electrical energy obtained by way of the energy converting mechanism.

According to the above-mentioned construction, reciprocating motion type expansion engines, the converting mechanism, the speed-up mechanism, and the energy converting mechanism are successively arranged substantially in a straight line along the main direction in which the pistons of the engines extend, enabling integral and compact assembly and hence contributing to miniaturization of the refrigerator.

A second object of the invention is to provide a refrigerator including a converting mechanism which is relatively thin in the main direction and has a first output shaft extending parallel to the main direction. In order to attain such second object, a cylindrical cam having a second output shaft extending along the main direction and driven by the reciprocating motion of the pistons for rotation is used for the converting mechanism. By the use of such cylindrical cam, the converting mechanism may be improved in simplicity, compactness and smoothness of operation as compared with the conventional one employing a crank mechanism.

A third object of the invention is to provide a refrigerator employing for the speed-up mechanism which has a second output shaft parallel to the main direction and is shortened in the main direction. In order to attain this object, the speed-up mechanism used for the refrigerator of the invention is of a planetary gear system, including a plurality of planet gears revolved by a first output shaft, a sun gear mounted on the second output shaft and engaging the planet gears, and a fixed internal gear engaging the planet gears. As capable of reduction in the dimension along the main direction, the speed-up mechanism of the aforementioned construction is a great convenience to the miniaturization of the main unit of refrigerator of the invention.

Moreover, a fourth object of the invention is to provide a simple and light generator section with reduced thickness in the main direction for the energy converting mechanism included in the energy consuming mechanism. In order to attain this object, the energy converting mechanism is provided with a generator section composed of an exciting rotor mounted on the second output shaft of the speed-up mechanism and generating coils generating electric power by interaction with magnetic flux produced by the rotor. The generator section of the refrigerator of the invention having such construction can be formed into a thin body.

A fifth object of the invention is to provide a refrigerator including a generator section including the exciting rotor which is simple in construction and hardly breaks down. In order to attain this object, a plurality of permanent magnets are used as a magnetic flux source for the rotor. The use of such permanent magnets enables us to remove slip ring which may otherwise be required for receiving electric current to the rotor from the outside, contributing to the simplified construction and compactness of the generator section.

Further, a sixth object of the invention is to provide a refrigerator including a means for maintaining the operating speed of the expansion engines substantially at a fixed level. In order to attain this object, the refrigerator of the invention is provided with a control means to operate when the rotation speed of the converting mechanism or speed-up mechanism is changed from a predetermined level, thereby adjusting a current flow to the load means so as to keep the operating speed of the engines substantially constant. By the use of such control means, the operation of the expansion engines can be performed substantially at a fixed speed and stabilized.

A seventh object of the invention is to provide a refrigerator in which the expansion engines, converter mechanism, speed-up mechanism, and the generator means are arranged substantially in a straight line along the main direction. In order to attain this object, the first output shaft of the converter mechanism and the speed-up mechanism are coaxially arranged substantially in a straight line. By doing this, the engines, converter mechanism, speed-up mechanism, and the generator means may be brought into alignment with one another.

Such arrangement makes the main unit of refrigerator of the invention relatively elongated, simple and compact.

Furthermore, an eighth object of the invention is to provide a refrigerator capable of achieving all of the first to seventh objects. In order to attain such eighth object, it is necessary only that the refrigerator of the invention be provided with all the object attaining means described in connection with the individual objects. Thus, there may be obtained effects or advantages corresponding to the first to seventh objects.

This invention can be more fully understood from the following detailed description when taken in conjunction with the accompanying drawings, in which.

Figure 1:
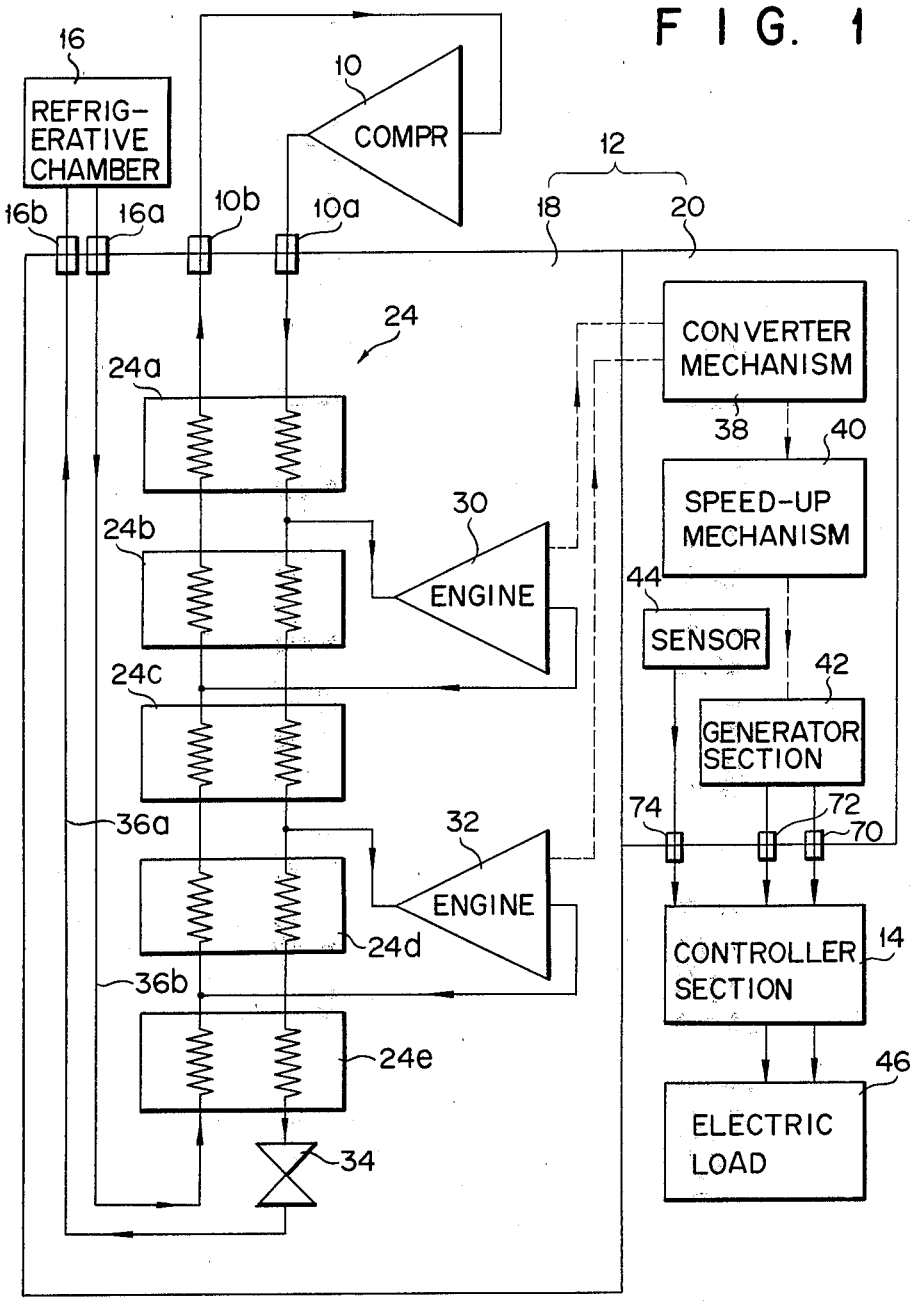
FIG. 1 is a block diagram of a refrigerator of this invention.

FIG. 1 is a block diagram of the refrigerator of this invention. As shown in this drawing, the refrigerator comprises a compressor 10, a main unit of refrigerator 12, a controller 14, a refrigerator chamber 16, and an electric load 46. The main unit 12 is composed of a refrigeration means or refrigerator section 18 and a power absorbing section 20. The refrigerator section 18 includes a substantially cylindrical vacuum tank 22, a heat exchanger group 24 consisting of five heat exchangers 24*a*, 24*b*, 24*c*, 24*d* and 24*e* disposed in the tank 22, two reciprocating motion type expansion engines (hereinafter referred to simply as engines) 30 and 32, and a Joule-Thomson valve 34. A high-pressure refrigerant delivered from the compressor 10 is introduced into the vacuum tank 22 and passed through the heat exchanger 24*a* to be cooled in some measure, and thereafter a part of such refrigerant is supplied to the engine 30. Supplied with the high-pressure refrigerant, the engine 30 is started to generate mechanical power caused by reciprocating motion of piston, and the refrigerant lowered in temperature and in pressure is returned to the compressor 10 via the heat exchangers 24*b* and 24*a*. At this time, the high-pressure refrigerant passing through the heat exchangers 24*a* and 24*b* is cooled by the low-temperature, low-pressure refrigerant. The engine 32 is supplied with part of the high-pressure refrigerant which has passed through the heat exchanger 24*c*, thereby generating mechanical power in the same as the engine 30 and returning the refrigerant reduced in temperature and pressure to the compressor 10 successively through the heat exchangers 24*d*, 24*c*, 24*b* and 24*a*. Thereupon, the high-pressure refrigerant passing through the heat exchangers 24*a* to 24*d* is cooled. The high-pressure refrigerant except the portion branched off to the engines 30 and 32 is reduced in temperature and pressure when it is passed through the Joule-Thomson valve 34, transmitted through a passage 36*a* to the prescribed refrigerator chamger 16 outside the vacuum tank 22, and then returned to the vacuum tank 22 through a passage 36*b*. The high-pressure refrigerant passing through the heat exchangers 24*e* to 24*a* is cooled by the refrigerant from the passage 36*b* together with the low-pressure, low-temperature refrigerant transmitted from the engines 30 and 32.

The power absorbing section 20 includes a converter mechanism 38, a speed-up mechanism 40, an energy conversion mechanism or generator section 42, and a sensor 44. The power absorbing section 20 and the refrigerator 14 are constructed in a body to form the main unit 12. The converter mechanism 38 is driven by the reciprocating motion of the pistons of the engines 30 and 32 to convert the reciprocating motion into rotation. The speed-up mechanism 40 increases the speed of the rotation delivered from the mechanism 38, and drives the generator section 42 at high speed. Broken lines in FIG. 1 represent mechanical connection. Electric power generated at the generator section 42 is transmitted through the controller 14 to the load means or electric load 46, where it is consumed. Thus, the generator section 42, controller 14 and electric load 46 convert the mechanical energy, which is produced by the engines 30 and 32 and converted into energy of accelerated rotation, into electrical energy, and consume such energy.

Figure 2:
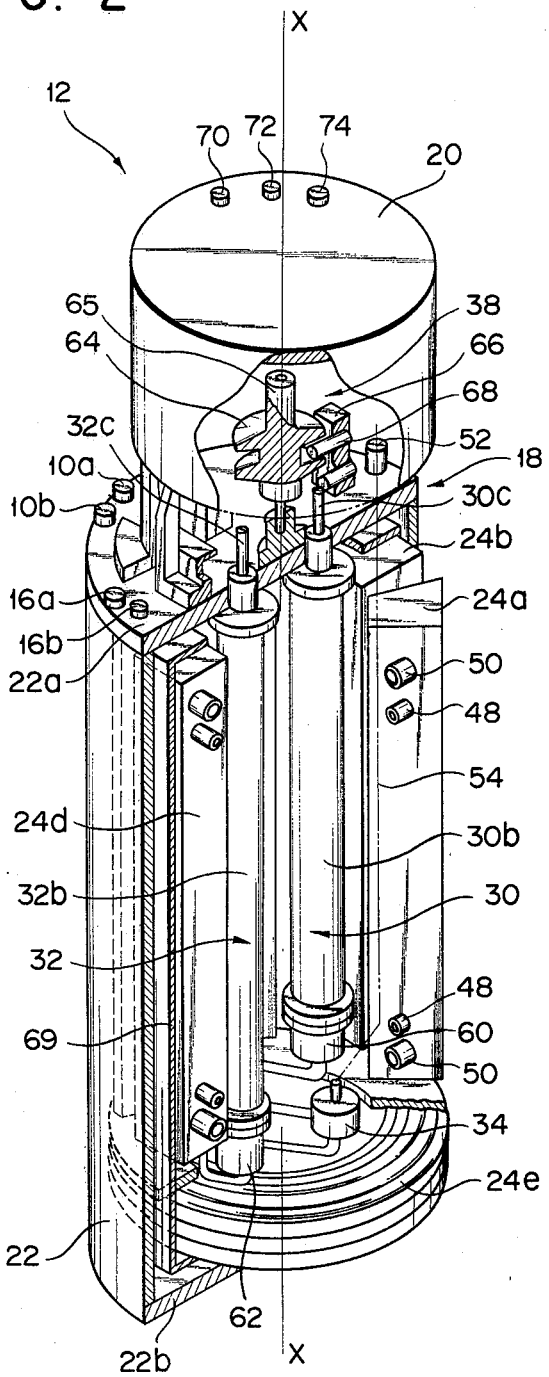
FIG. 2 is a partially sectional perspective view of a main unit of the refrigerator of FIG. 1.

FIG. 2 is a partially sectional perspective view of the main refrigerator unit 12, chiefly showing members inside the vacuum tank 22 and the principal part of the converter mechanism 38 included in the power absorbing section 20. The vacuum tank 22, which is substantially cylindrical, contains therein the engines 30 and 32 respectively having cylinders 30*b* and 32*b* extending substantially parallel to the central axis X0X of the cylindrical body. Further, connecting rods 30*c* and 32*c* of pistons 30*a* and 32*a* (FIG. 3) used for the cylinders 30*b* and 32*b* extend substantially parallel to the central axis X—X to project from a top cover 22*a* of the vacuum tank 22, and are allowed to reciprocate. The four heat exchangers 24*a*, 24*b*, 24*c*, and 24*d* are arranged around the engines 30 and 32, while the heat exchanger 24*e* is disposed near a base plate 22*b* of the vacuum tank 22 across a heat shielding plate 69 in contact with the heat exchanger 24*a*. The Joule-Thomson valve 34 is disposed below the engines 30 and 32. Thinner pipes 48 appearing on this side of the heat exchanger 24*a* constitute inlet and outlet for the high-pressure refrigerant passing through the heat exchanger 24*a*, while thicker pipes 50 serve as inlet and outlet for the low-pressure refrigerant passing through the heat exchanger 24*a*. The same system is applied to the other heat exchangers including e.g. the heat exchanger 24*d*. An adjusting knob 52 located above the top cover 22*a* is used for adjusting the opening of the Joule-Thomson valve 34 by means of a control rod 54 represented simply by a chain line. Numerals 10*a* and 10*b* designate passage connecting portions coupled respectively to the high-pressure refrigerant outlet and low-pressure refrigerant inlet of the compressor 10, while 16*a* and 16*b* denote passage connecting portions which deliver to the refrigerator chamber 16 and receive the low-temperature, low-pressure refrigerant passed through the Joule-Thomson valve 34, respectively. Since the heat exchangers 24*a* to 24*e*, engines 30 and 32, and refrigerant passages between the Joule-Thomson valve 34 and the passage connecting portions 10*a*, 10*b*, 16*a* and 16*b* are clearly shown in FIG. 1, they are mostly omitted in FIG. 2.

Figure 3:
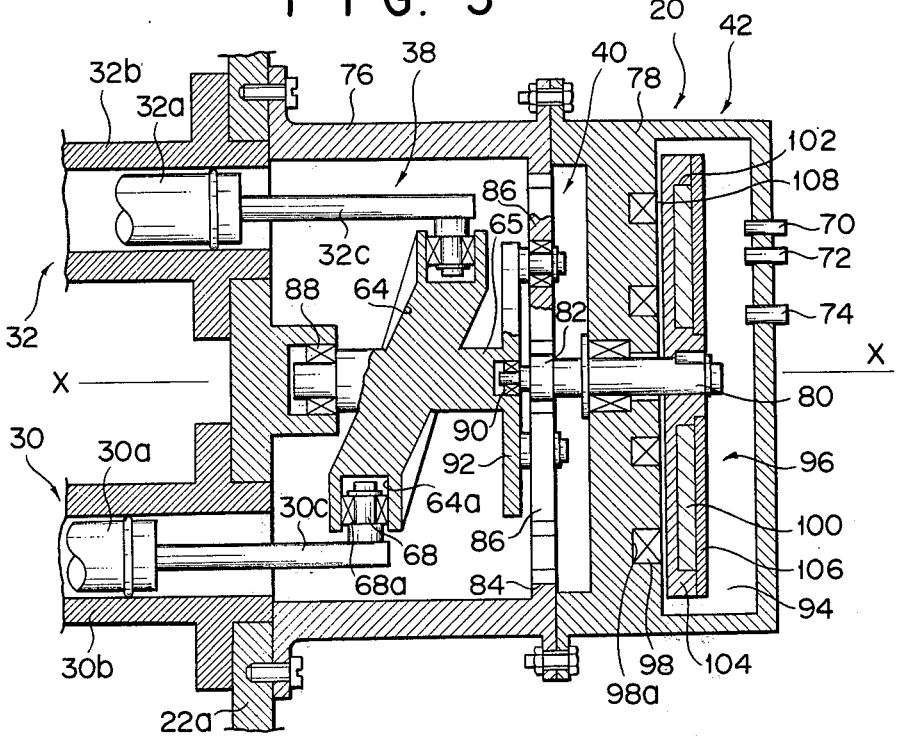
FIG. 3 is a sectional view of a power absorbing section as shown in FIG. 2.

Inside the power absorbing section 20 of FIG. 2, there is shown the principal part of the converter mechanism 38. Numeral 64 designates a cylindrical cam mounted on the same central axis X—X which converts reciprocating motion of the connecting rods 30*c* and 32*c* along the axis X—X, which is caused when the engines 30 and 32 are driven, into rotation about the axis X—X. Numeral 65 designates the output shaft of the cylindrical cam 64. Numeral 66 designates a coupling block which is attached to the tip end of the connecting rod 30*c* and transmits the reciprocating motion of the piston 30*a* (FIG. 3) to the cylindrical cam through a pin 68. The construction of this section is also shown in FIG. 3. A coupling block to be attached to the tip end of the connecting rod 32 of FIG. 2 is omitted for the simplicity of the drawing. Terminals 70 and 72 protruding at the upper portion of the power absorbing section 20 are wiring terminals for supplying the controller 14 with electric power generated at the generator section 42 (FIGS. 1 and 3) included in the power absorbing section 20, while a terminal 74 is disposed inside the power absorbing section 20 and tends to detect the output-side rotation speed of the speed-up mechanism 40 and to supply the controller 14 with the output of the sensor 44 which delivers the result of the detection to the controller 14. Moreover, numerals 60 and 62 designate automatic valve units containing suction and exhaust valves that are used with the engines 30 and 32, respectively. When the engines 30 and 32 are supplied with the high-pressure refrigerant, the automatic valve units 60 and 62 are actuated to cause the pistons 30*a* and 32*a* of the engines 30 and 32 to start reciprocation.

FIG. 3 shows a sectional view of the power absorbing section 20 and a partial sectional view of the refrigerator section 18. The connecting rods 30*c* and 32*c* extending respectively from the pistons 30*a* and 32*a* of the engines 30 and 32 project through the top cover 22*a* into the interior of an intermediate frame 76 attached to the top cover 22*a*, and reciprocate in the direction of the central axis X—X. The converter mechanism 38 as illustrated is composed of the cylindrical cam 64, and the pins 68 and ball bearings 68*a* attached to the tip ends of the connecting rods 30*c* and 32*c*. Formed on and around the surface of the cylindrical cam 64 is a cam groove 64*a* which converts the reciprocating motion of the connecting rods 30*c* and 32*c* into rotation of the cylindrical cam 64. Thus, when the engines 30 and 32 are operated, the cylindrical cam 64 is rotated by the action of the converter mechanism 38.

The planetary gear type speed-up mechanism 40 is disposed at the right end portion of the intermediate frame 76. The mechanism 40 includes a sun gear 82 mounted on a rotating shaft or output shaft 80 supported coaxially with the central axis X—X by an end frame 78 of magnetically soft material i.e. strong magnetism-material having high permeability on the right of the intermediate frame 76, an internal gear 84 at the right end portion of the intermediate frame 76, and three planet gears 86 engaging the gears 82 and 84. The cylindrical cam 64 is borne by a ball bearing 88 attached to the top cover 22*a* and a ball bearing 90 attached to the left end of the rotating shaft 80. Numeral 92 designates a disk at the right end portion of the cylindrical cam 64, and the three planet gears are rotatably mounted on the disk 92 at angular intervals of 120°. Accordingly, when the cylindrical cam 64 rotates, the three planet gears 86 orbit the sun gear 82 at the same speed with the rotation of the cylindrical cam 64. In this case, the internal gear 84 is fixedly attached to the intermediate frame 76, so that the sun gear 82 and hence the rotating shaft 80 rotate faster than the cylindrical cam 64. The ratio between the rotating speeds of the shaft 80 and the cylindrical cam 64 may be set to various values by diversely selecting the numbers of teeth of the sun gear 82, internal gear 84, and planet gear 86.

Figure 4:
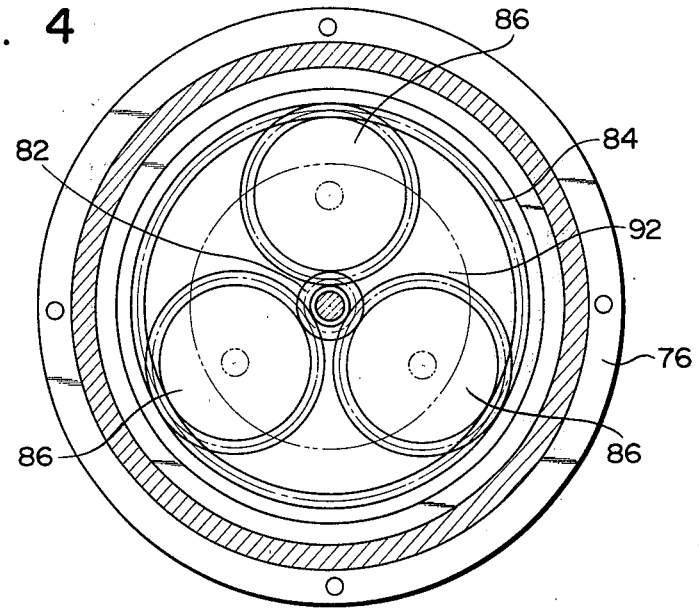
FIG. 4 shows a gear arrangement of a planetary gear assembly used with the power absorbing section of FIG. 3.

FIG. 4 shows the positional relationship between the internal gear 84, planet gear 86, and sun gear 82 as viewed from the left-hand side and taken at right angles to the central axis X—X of FIG. 3. The disk 92 attached to the cylindrical cam 64 and sustaining the planet gears 86 is represented by a chain line.

The end frame 78 is fitted with the generator section 42. The generator section 42 includes a thick discoid rotating part or rotor 96 keyed to the shaft 80 inside a chanber 94 defined in the end frame 78, and a plurality of generating coils 98 fitted in grooves 98*a* formed in the end frame 78. The rotor 96 is composed of an annular permanent magnet 100 so magnetized as to have a plurality of magnetic poles, a magnetic holder 104 of nonmagnetic material to hold the permanent magnet 100 in its annular recess 102, and a cover 106 of magnetically soft material i.e. strong magnetism-material having high permeability attached to the magnet holder 102 in close contact with the permanent magnet 100 so as to retain the magnet 100 in the recess 102 and serving as a backplate for the magnet 100 to provide a magnetic path. The rotor 96 faces a wall surface of the chamber 94 fitted with the generating coils 98 across an air gap 108.

Figure 5:
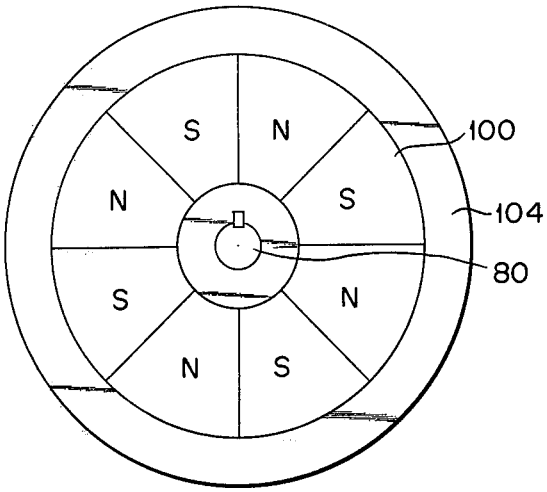
FIG. 5 shows an arrangement of magnetic poles formed in permanent magnets for a generator section included in the power absorbing section of FIG. 3.

FIG. 5 is a view of the rotor 96 cleared of the cover 106 as taken from the right of FIG. 3, showing the polarity distribution of the magnetic poles formed in the permanent magnet 100. Each shown polarity is one on this side of the drawing, and magnetic poles on the other side have opposite polarity.

Figure 6:
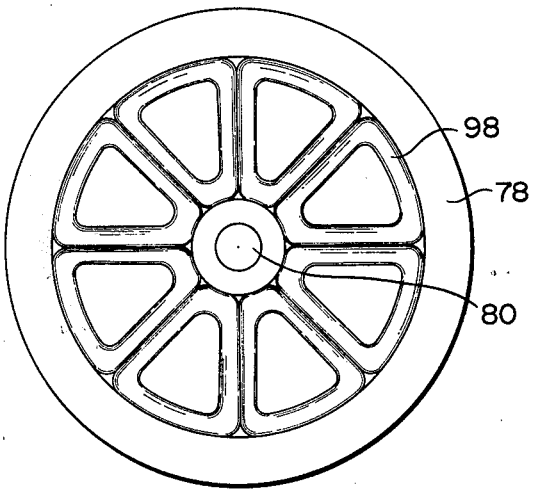
FIG. 6 shows a coil arrangement of the generator section.

FIG. 6 shows the arrangement of the generating coils 98 as viewed from the right of FIG. 3.

Magnetic flux produced from the permanent magnet 100 passes through a portion of the end frame 78 facing the rotor 96, that is, the region where the generating coils 98 are arranged. Accordingly, when the engines 30 and 32 are started to rotate the rotor 96 at high speed, the magnetic flux from the permanent magnet 100 moves across the coil sides of the generating coils 98, so that AC voltages are induced at the respective generating coils 98. These voltages are added together by suitable connection means and led through the terminals 70 and 72 to the controller 14.

Figure 7:
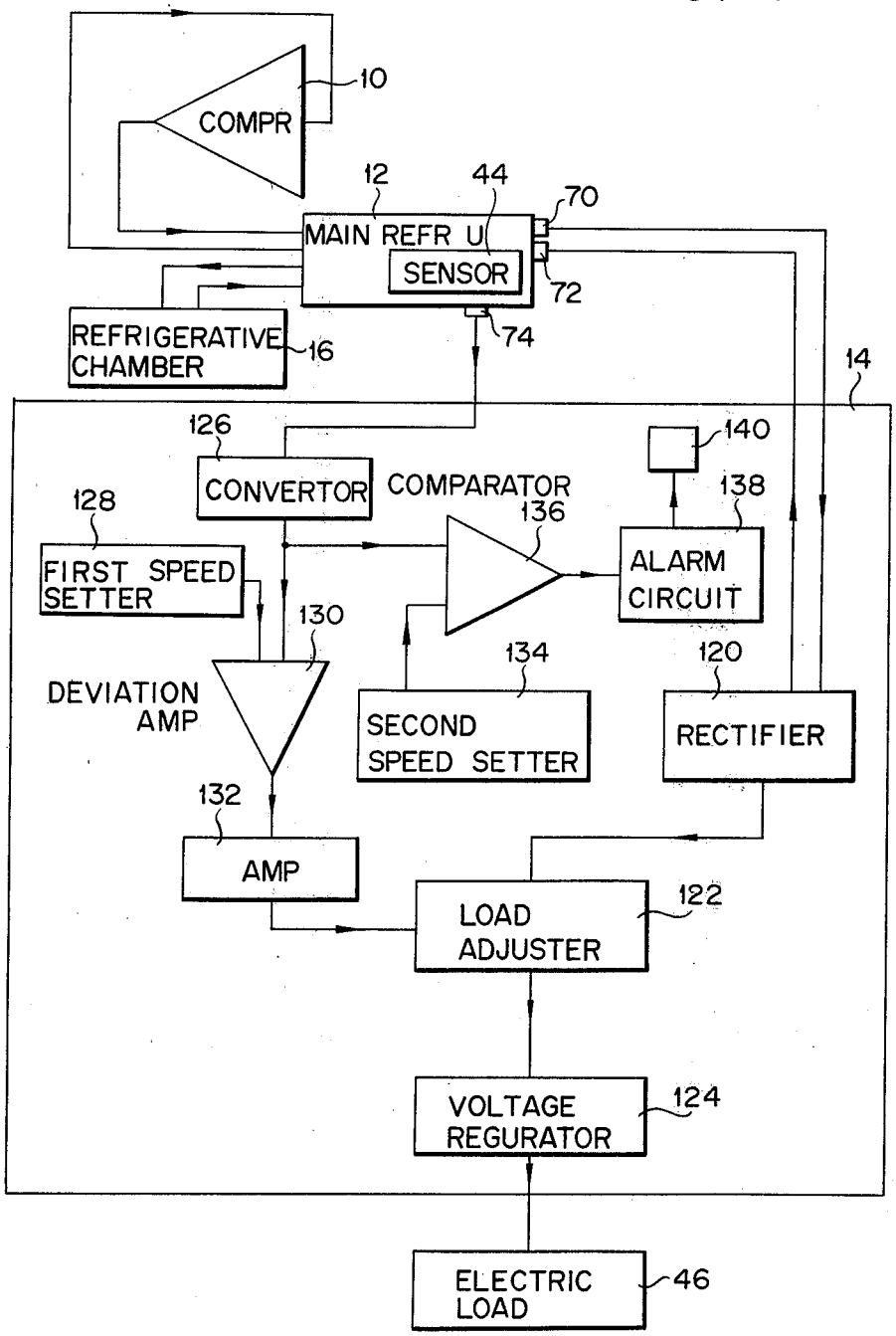
FIG. 7 shows the construction and function of a controller 14 as shown in FIG. 1.

FIG. 7 is a block diagram for illustrating the construction and operation of the controller 14. Electric power delivered from the generating section 42 is sent to a rectifier 120 in the controller 14, where it is converted into DC power. The DC power is supplied to the external electric load 46 through a load adjuster 122 and a constant-voltage regulator 124. The load adjuster 122 controls electric power supplied to the electric load 46, assisting the engines 30 and 32 in operating at a predetermined speed.

The load adjuster 122 operates in accordance with the detection value from the sensor 44 to detect the rotation speed of the shaft 80 (FIG. 3) in the power absorbing section 20. A detection signal delivered from the sensor 44, which is a frequency signal in proportion to the rotation speed of the shaft 80, is converted into a voltage proportional to the rotation speed by an F/V converter 126. This voltage is supplied to a deviation amplifier 130, together with a set voltage determined by a rotation speed setter 128. The output of the deviation amplifier 130 is a voltage which is proportional to the difference between the set voltage and the output voltage of the converter 126. The obtained output voltage is amplified by an amplifier 132, and then supplied to the load adjuster 122. The power transmitted to the regulator 124 is controlled by a voltage signal supplied from the amplifier 132 as follows. Namely, when the rotation speed of the shaft 80 is higher than a value corresponding to the set value of the first setter or rotation speed setter 128, the control signal delivered from the amplifier 132 acts on the load adjuster 122 so as to increase the power supplied to the electric load 46. When the rotation speed of the shaft 80 is lower than the set value, on the other hand, the signal so functions as to decrease the power supplied to the electric load 46. Accordingly, mechanical load applied to the shaft 80 through the generator section 42 is varied by changing the rotation speed of the shaft 80 as compared with the predetermined value. Thus, the rotation speed of the shaft 80 may be maintained substantially at the value determined by the rotation speed setter 128.

The output of the converter 126 is transmitted to a comparator 136 together with the set value for the shaft 80 delivered from a second setter or maximum rotation speed setter 134. When the rotation speed of the shaft 80 becomes higher than the value corresponding to the set value, an over-rotation alarm circuit 138 is actuated, and a danger signal is given from an alarm 140.

Although a typical refrigerator according to this invention has been described herein, various modifications may be effected. For example, instead of using the cylindrical cam for the converter mechanism 38, there may be employed a converting mechanism which utilizes the well-known swash plate system. Moreover, the number of engines, which is two for the above-mentioned embodiment, may be increased as required.

In any case, according to the refrigerator of the invention, the reciprocating motion of pistons obtained from a plurality of reciprocating motion type engines is converted into rotation and the rotation is accelerated to drive a load member on the engines, so that the load member, such as e.g. the generator section 42 for the above-mentioned embodiment, may be made compact. Since electric power generated by the generator section is consumed by the electric load 46 outside the main refrigerator unit 12, energy consumed within the main unit 12 is extremely little, making it easy to restrain the temperature of the main unit 12 from rising.

Furthermore, the main refrigerator unit 12 may be formed into a substantially cylindrical, compact body by employing for the speed-up mechanism 40 such mechanism that the input and output shafts are on the same axis like the planetary gear type mechanism of the aforementioned embodiment, as well as the cylindrical cam or swash plate system for the converter mechanism 38, and also by locating the generator section 42 coaxially with the speed-up mechanism 40. Such compaction or reduction in size enables the refrigerator of the invention to be placed in a train which utilizes magnetic elevation effect, and also to be set in any place that is limited in floor space.

What we claim is:

1. A refrigerator comprising:

a refrigerating means including a plurality of reciprocating motion type expansion engines with reciprocating pistons extending substantially parallel and in the same direction with one another from their corresponding cylinders;

a converter mechanism having a first output shaft parallel to the extending direction of the pistons or main direction and driven by said pistons, whereby reciprocating motion of said pistons is converted into rotation of said first output shaft;

a speed-up mechanism having a second output shaft parallel to said main direction and driven by said first output shaft, whereby said second output shaft is rotated faster than said first output shaft;

an energy consuming mechanism composed of an energy converting mechanism having a rotating part mounted on said second output shaft and converting mechanical energy supplied from said second output shaft into electrical energy and a load means to consume the electrical energy obtained by way of said energy converting mechanism; and a control means for automatically adjusting said load means so that the operating speed of said expansion engines may be maintained substantially at a fixed value.

2. A refrigerator according to claim 1, wherein said converter mechanism includes a cylindrical cam driven by the reciprocating motion of said pistons to rotate.

3. A refrigerator according to claim 1, wherein said speed-up mechanism is a planetary gear type speed-up mechanism including a plurality of planet gears mounted on said first output shaft of said converter mechanism, a fixed internal gear to revolve said planet gears, a sun gear engaging said planet gears and rotating faster than the orbiting motion of said planet gears, and said second output shaft erected on said sun gear along said main direction.

4. A refrigerator according to claim 1, wherein said energy converting mechanism included in said energy consuming mechanism is a generator means composed of the exciting rotor mounted on said second output shaft of said speed-up mechanism and generating coils generating electric power by interaction with magnetic flux produced by said rotor.

5. A refrigerator according to claim 4, wherein said rotor includes a plurality of permanent magnets to produce said magnetic flux.

6. A refrigerator according to claim 1 further comprising a control means for automatically adjusting said load means so that the operating speed of said expansion engines may be maintained substantially at a fixed value.

7. A refrigerator according to claim 1, wherein said first output shaft of said converter mechanism and said second output shaft of said speed-up mechanism are on the same straight line.

8. A refrigerator comprising:

a refrigerating means including reciprocating motion type expansion engines, the direction in which pistons extend from cylinders or the main directions being arranged substantially in parallel with one another;

a cylindrical cam having a first output shaft parallel to said main direction and driven by said pistons, whereby reciprocating motion of said pistons is converted into rotation of said first output shaft;

a planetary gear type speed-up mechanism including a plurality of planet gears mounted on said first output shaft, a fixed internal gear to revolve said planet gears, and a sun gear engaging said planet gears, rotating faster than the orbiting motion of said planet gears, and having a second output shaft coaxial with said first output shaft protruding in said main direction;

a rotor including a plurality of exciting permanent magnets mounted on said second output shaft and generating coils generating electric power by interaction with magnetic flux produced by said rotor; and a control means for automatically adjusting said load means so that the operating speed of said expansion engines may be maintained substantially at a fixed value.

* * * * *

UNITED STATES PATENT AND TRADEMARK OFFICE

CERTIFICATE OF CORRECTION

PATENT NO. : 4,337,399

DATED : June 29, 1982

INVENTOR(S) : HIROYUKI NAKAMURA ET AL.

It is certified that error appears in the above-identified patent and that said Letters Patent is hereby corrected as shown below:

Please correct the Foreign Application Priority Data as follows:

[30] -- Foreign Application Priority Data

Dec. 22, 1978 [JP] Japan.....53/174889[U] --

Signed and Sealed this

*Twenty-fourth* Day of *August 1982*

[SEAL]

*Attest:*

GERALD J. MOSSINGHOFF

*Attesting Officer*

*Commissioner of Patents and Trademarks*